US009246268B1

(12) United States Patent
Richardson et al.

(10) Patent No.: US 9,246,268 B1
(45) Date of Patent: Jan. 26, 2016

(54) DEVICE AND METHOD PROTECTING A CONNECTOR FROM DEBRIS WHILE VALIDATING CONNECTOR POSITION ASSURANCE ENGAGEMENT

(71) Applicant: NEXANS, Paris (FR)

(72) Inventors: Jeremy Richardson, Butler, PA (US); Brad A Angus, North Lima, OH (US); Ken Zalucki, Clinton Township, MI (US); Scott E Nemes, Youngstown, OH (US); John W Shaffer, Bristolville, OH (US)

(73) Assignee: NEXANS, Paris (FR)

( * ) Notice: Subject to any disclaimer, the term of this patent is extended or adjusted under 35 U.S.C. 154(b) by 0 days.

(21) Appl. No.: 14/460,506

(22) Filed: Aug. 15, 2014

(51) Int. Cl.
*H01R 13/627* (2006.01)
*H01R 13/629* (2006.01)
*H01R 13/52* (2006.01)

(52) U.S. Cl.
CPC ..... *H01R 13/6272* (2013.01); *H01R 13/52* (2013.01); *H01R 13/629* (2013.01)

(58) Field of Classification Search
CPC ..... H01R 13/6272; H01R 13/6275; H01R 13/641
See application file for complete search history.

(56) References Cited

U.S. PATENT DOCUMENTS 6,004,153 A * 12/1999 Myer ..... H01R 13/641 439/352
2004/0087206 A1* 5/2004 Grubbs ..... H01R 13/52 439/489
2004/0192099 A1* 9/2004 Seminara ..... H01R 13/639 439/352

* cited by examiner

*Primary Examiner* — Gary Paumen
(74) *Attorney, Agent, or Firm* — Sofer & Haroun, LLP

(57) ABSTRACT

The present arrangement provides for a protection device having a deflector element with a receiving slot on its underside and a CPA assist coupled to the deflector element. The CPA assist is configured to be moved from the first pre-staged position to the second active position by pressing the CPA assist to engage a CPA positioned within the CPA slot. The protection device is configured to be placed onto a connector with the receiving slot configured to be placed over a CPA slot on the connector.

3 Claims, 6 Drawing Sheets

Slide in final position

Slide in Pre-Staged position

DEVICE AND METHOD PROTECTING A CONNECTOR FROM DEBRIS WHILE VALIDATING CONNECTOR POSITION ASSURANCE ENGAGEMENT

BACKGROUND

1. Field of the Invention

This patent application relates to a device for protecting a connector lock and CPA (Connector Position Assurance device) from debris while providing CPA engagement and improving assembly ergonomics. More particularly, this application relates to device for protecting the electrical connector lock area and CPA from debris and ensuring CPA engagement and serviceability (examples of debris including, but not limited to, paint, dirt, dust, stone, sand, and spray).

2. Description of Related Art

Existing electrical connectors located in a vehicle engine compartment can include inline wire harness to wire harness connections (Female to Male interface) as well as device specific connections (e.g. EGR (Exhaust Gas Recirculation), TPS (Throttle Position Sensor), Coolant Temp, Intake Temp, and Oil Temp). Inside passenger compartment electrical connectors can include inline wire harness to wire harness connections (Female to Male interface) and device specific connections (e.g. Power Seat, Power Window, Power Lock, and Auxiliary Power).

As part of the design of these connectors, male and female, the connectors are arranged to either be manually or automatically mated to one another at some point of assembly. After the connectors are mated and locked together, a Connector Position Assurance device is additionally used to ensure the connectors are properly mated together.

The CPA is used in end products allowing for increased production rates and greater quality control by more readily permitting visual inspection of the electrical connectors for proper connection. Typically, the CPA is inserted in a pre-staged position into an integrated CPA slot, e.g. positioned on the top of the female connector, prior to the connectors being assembled together as shown in more detail below. The term "pre-staged" simply means that the CPA is not fully inserted in the CPA slot on the connector.

Once the connectors are assembled together and locked using the connector locks, their proper engagement can be verified by the CPA device. Thus, the electrical connectors have been properly engaged if the CPA can be inserted into active position within the CPA slot on the top of the female connector. If the CPA lock cannot be inserted/activated into the assembled electrical connectors, it is an indication that the electrical connectors are not properly engaged. See for example U.S. Pat. No. 5,236,373.

For example in the manufacturing of commercial, automotive, and agricultural engines utilizing an EGR system, most engines utilize an EGR Delta Pressure device typically using a Framatome Apex 2.8 Female 3 cavity connector (model #54200309) with integrated CPA slot mating to the device. An example of this connector is shown in FIG. 1. The 54200309 connector has 3 cavities available to accept 3 wires with female terminals applied. FIG. 2 shows this same Apex 2.8 connector with a CPA in the CPA slot in the pre-staged position. Upon mating the female connector (54200309) with the pre-staged CPA to the corresponding male connector, the CPA is then engaged/activated by sliding (pushing) the CPA into its locked position. FIG. 3 shows the female connector mated to a male connector with the CPA engaged into the CPA slot. While this CPA is in place, the connectors cannot be separated and the connector lock cannot be fully disengaged.

However, during its intended use in an automobile or other manufacturing item the illustrated connected connectors (FIG. 3) are typically subjected to many other processes during assembly. For example, painting or coating processes may result in paint/debris coating the connectors effectively sealing the connector in the locked position by paint/gluing the CPA in place. As a result if there is a desire to disconnect the connectors for maintenance, because the CPA is essentially glued into the connector/CPA slot, the maintenance personal may have to cut the wires to disconnect the part.

In the prior art, to protect the CPA and CPA slot from the painting process some manufactures use rubber boots (high cost) or masking tape (labor intensive). This lessens the risk of rendering the CPA from becoming permanently locked/inoperable. However, these methods are costly and, depending on the application, could inadvertently be removed during other assembly processes.

OBJECTS AND SUMMARY

The present arrangement overcomes the drawbacks of the prior art by providing a deflector protection device that couples with a connector to cover the CPA and CPA slot, so that during other assembly processes such as painting, clear coating or undercoating, the CPA and CPA slot are shielded from debris/paint/spray.

To this end, a device is provided that has both a debris deflector and a built in CPA assist. In one embodiment, the debris deflector is a (sufficiently) large shield that covers the CPA slot and the CPA in the pre-staged arrangement. The device further includes a CPA assist that is configured to engage the pre-staged CPA (now covered by the debris deflector) so that it can allow the manufacturer to engage the now protected CPA when desired.

When first applied to the connector, the deflector has the CPA assist held in a pre-staged position, matching the pre-stage CPA under the deflector. After attachment with the opposing connector the CPA assist is engaged by the manufacturer, causing a corresponding engagement of the CPA. While the manufacturing item continues to be assembled, the manufacturing item (e.g. automotive engine) can be subject to other assembly processes with the debris deflector protecting the CPA and CPA slot. Therefore, once other assembly processes are completed (such as painting, undercoating, etc.), the mated connection system and CPA remains serviceable/dis-connectable while simultaneously increasing the effectiveness and speed of assembly over prior art designs.

In the present arrangement, the invention is described as relating to electrical connectors used in an engine assembly setting however the features of the invention may be used in a similar fashion on any connectors in any related situations where a manufacturing process subjects a mated connection to some form of debris emitting processes, such as painting or coating.

To this end, the present arrangement provides for a protection device having a deflector element with a receiving slot on its underside and a CPA assist coupled to the deflector element. The CPA assist is configured to be moved from the first pre-staged position to the second active position by pressing the CPA assist to engage a CPA positioned within the CPA slot.

The protection device is configured to be placed onto a connector with the receiving slot configured to be placed over a CPA slot on the connector.

BRIEF DESCRIPTION OF THE DRAWINGS

The present invention can be best understood through the following description and accompanying drawings, wherein.

DETAILED DESCRIPTION

Figure 4:
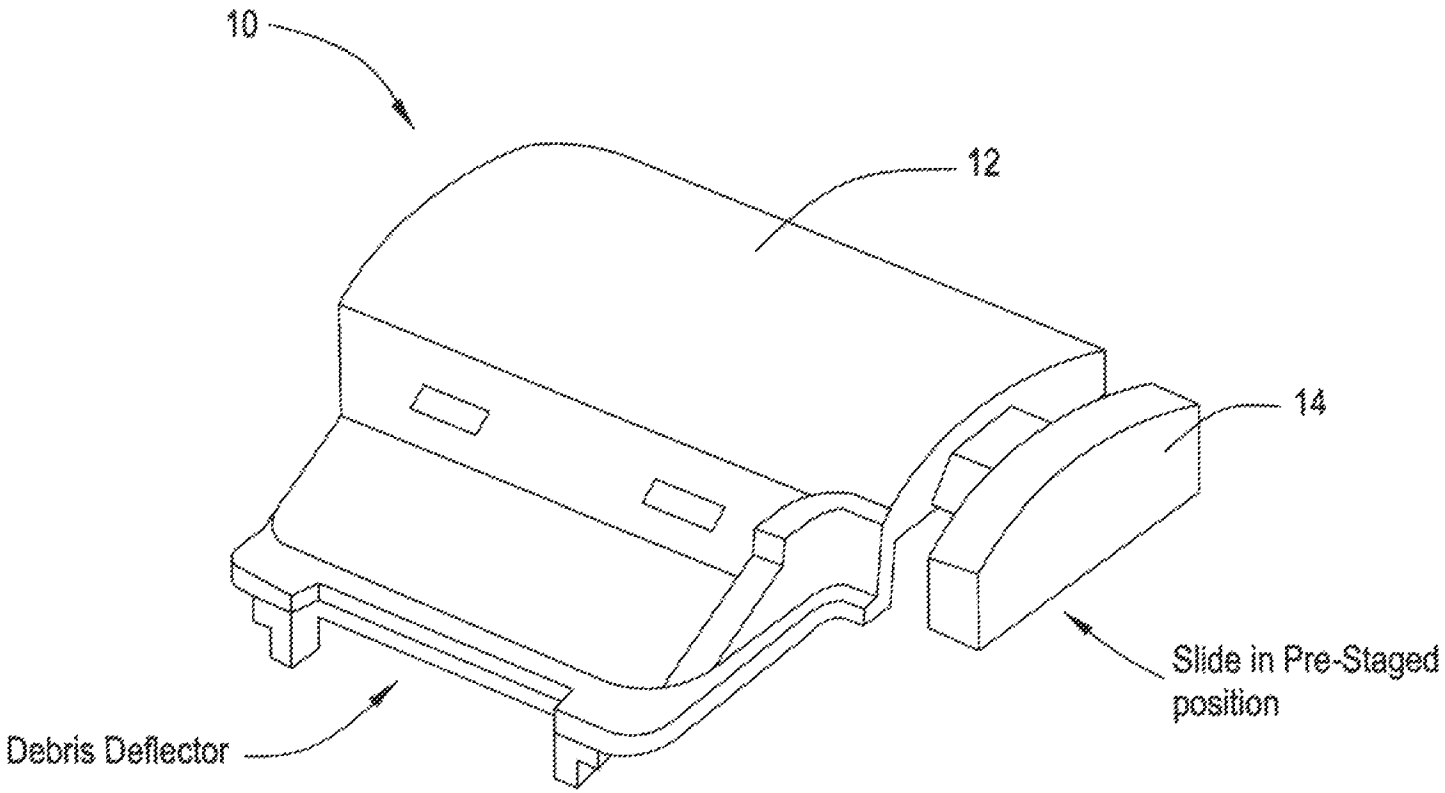
FIG. 4 shows a top perspective view of a protection element in accordance with one embodiment.

In one embodiment of the present invention as shown in FIG. 4, a protection device 10 includes two components, a deflector element 12 and a CPA assist 14. In one preferred embodiment, device 10 is constructed from Nylon™, however protection device 10 can be constructed of other materials as desired depending on the cost and protection requirements.

Figure 1:
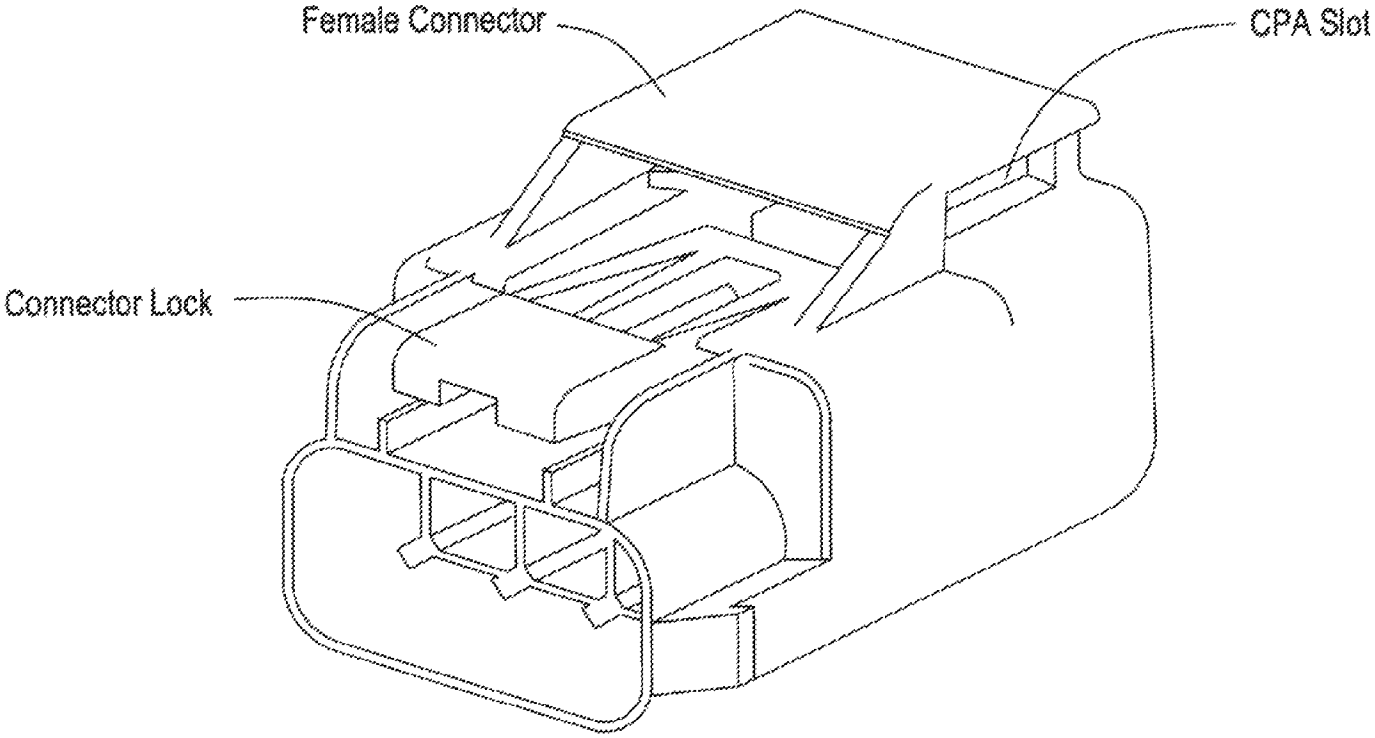
FIG. 1 (PRIOR ART)
FIG. 1 shows a prior art arrangement of a connector with an integrated CPA slot.
Figure 2:
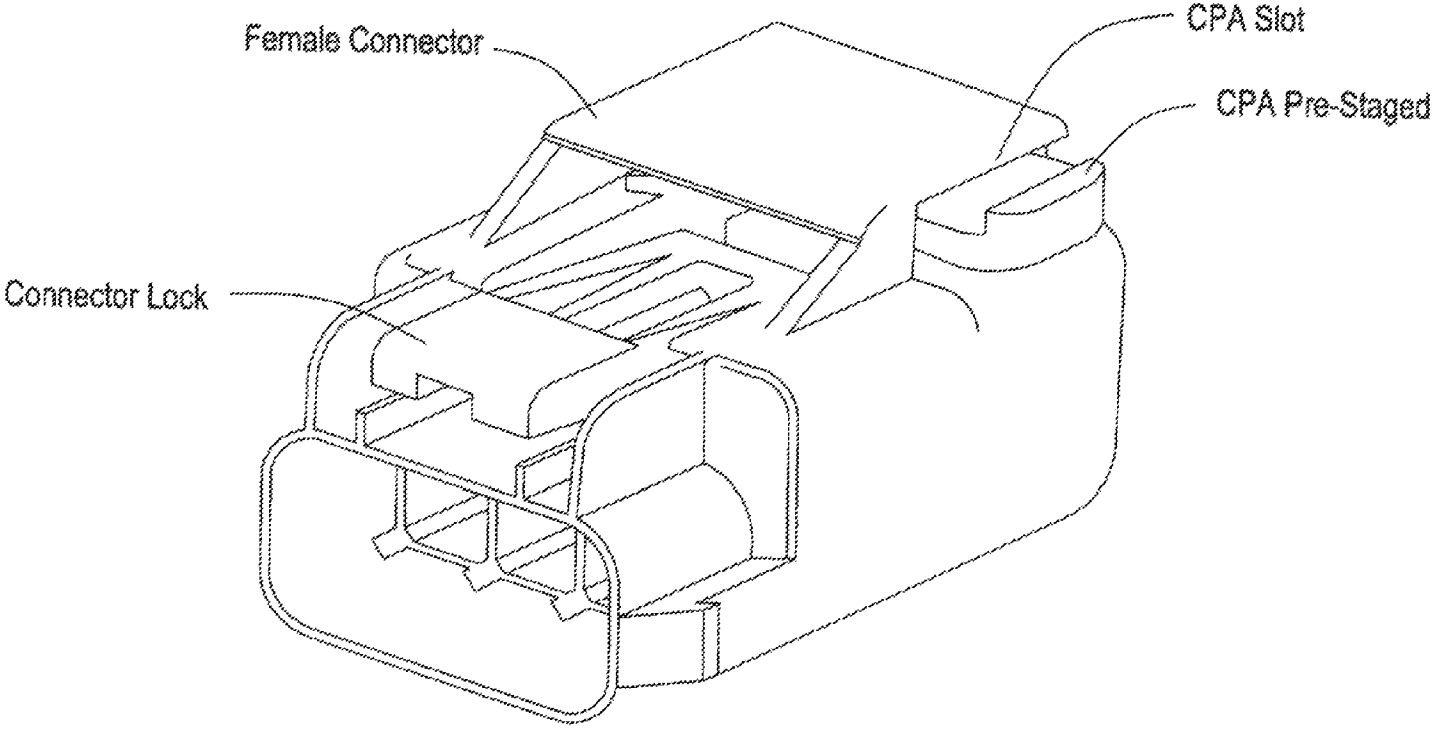
FIG. 2 (PRIOR ART)
FIG. 2 shows a prior art arrangement of a connector with a pre-staged CPA in the integrated CPA slot.
Figure 3:
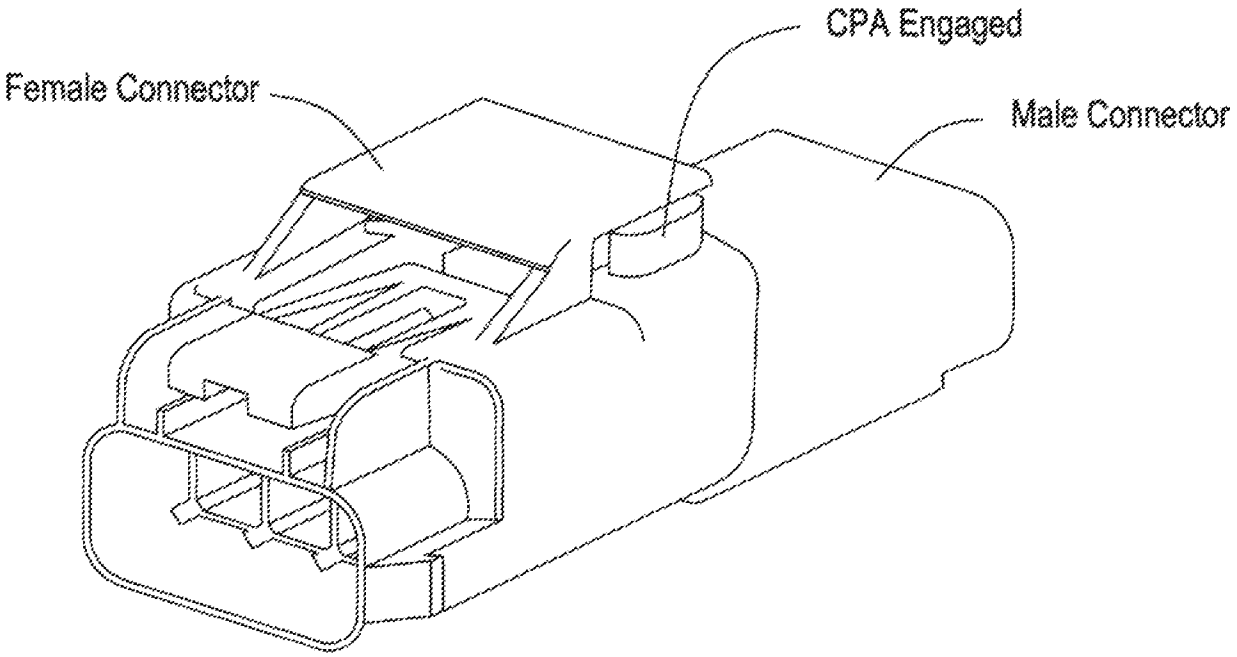
FIG. 3 (PRIOR ART)
FIG. 3 shows a prior art arrangement of two mated connectors with an engaged CPA in the integrated CPA slot.

In the embodiment shown in FIG. 4, deflector element 12 of protection device 10 is constructed to match a particular connector, such as for example the above described Apex 2.8 connector shown in FIGS. 1-3. However, it is understood that the present protection device can be re-dimensioned to fit any number of sized and shaped connectors that utilize CPA systems. In this presently described arrangement, deflector 12, and CPA assist 14 form a Nylon™ shield approximately 28 mm×28 mm and about 8 mm in thickness/height.

Figure 5:
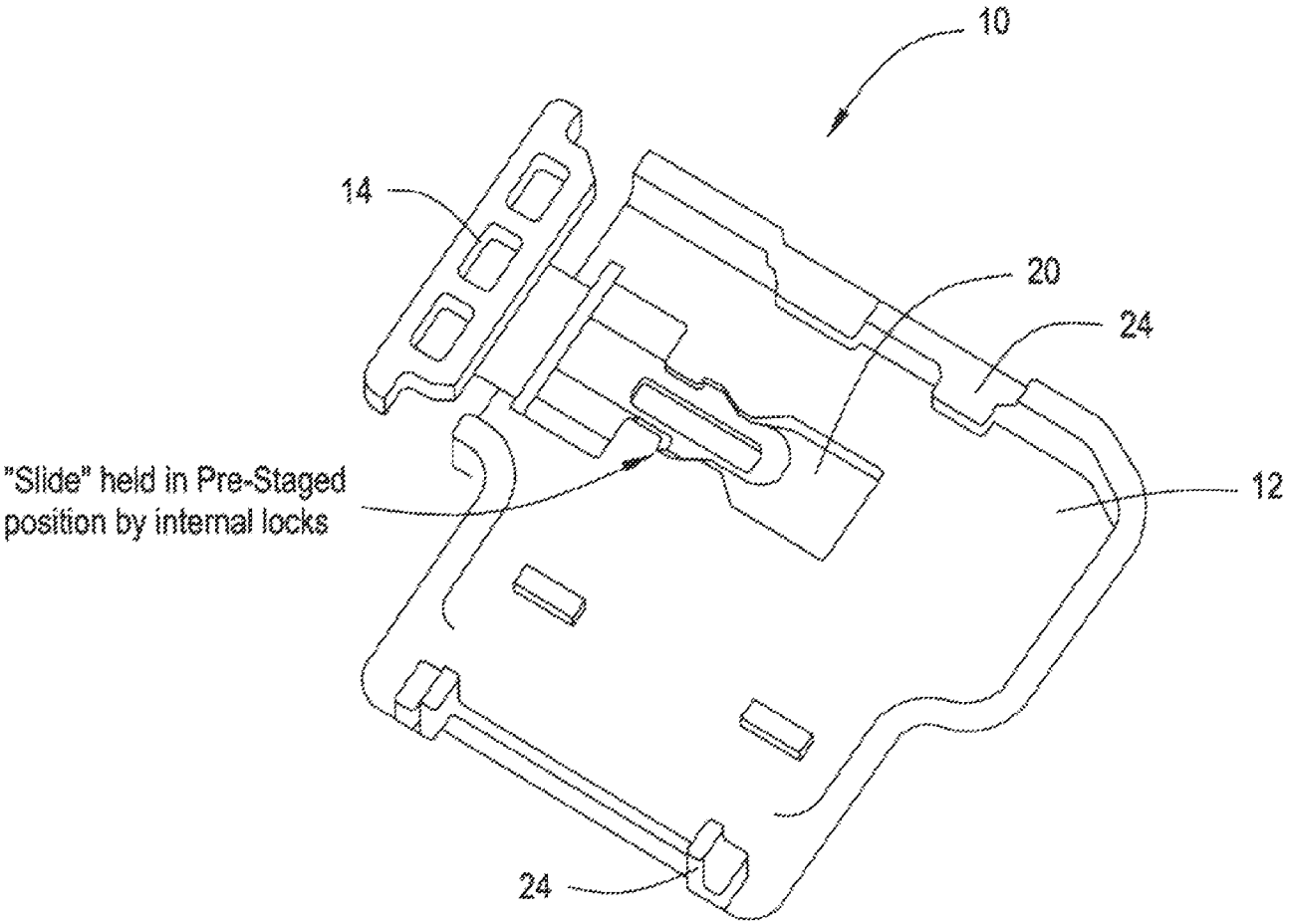
FIG. 5 shows a bottom view of the protection element in accordance with one embodiment.

As shown in FIG. 5, the underside of device 10 shows that deflector element 12 has a receiving slot 20 for correctly fitting over the projection/CPA slot at the top of the female connector (e.g. as shown in FIGS. 1-2) as well as for allowing the CPA assist element 14 to move therein, so that it allows CPA assist element 14 to be held in a first pre-staged position and then slid into a second active position to contact/activate the pre-staged CPA in the slot, as described in more detail below. CPA assist 14 is dimensioned such that it slides within receiving slot 20 from the pre-staged to the engaged position through deflection of the inner portion of the assist until it is pressed all the way in or engaged. While sliding within slot 20, the larger thumb push portion which abuts the CPA also moves inwards pressing the CPA into the CPA slot engaging the CPA.

It is noted that the underside of deflector 12 as shown in FIG. 5 has various snap clips 24 that correspond to various ridges or physical features of the top of the connector for proper mating of device 10 to connector.

Figure 7:
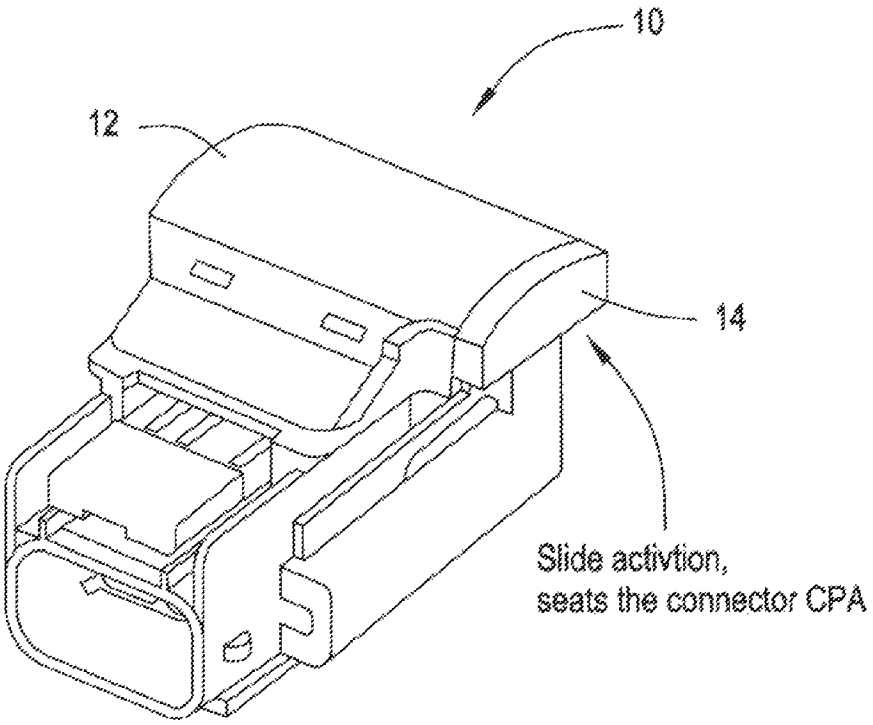
FIGS. 6 and 7 show a connector with the protection element with the CPA assist in a pre-staged and final engaged position, respectively in accordance with one embodiment.
Figure 6:
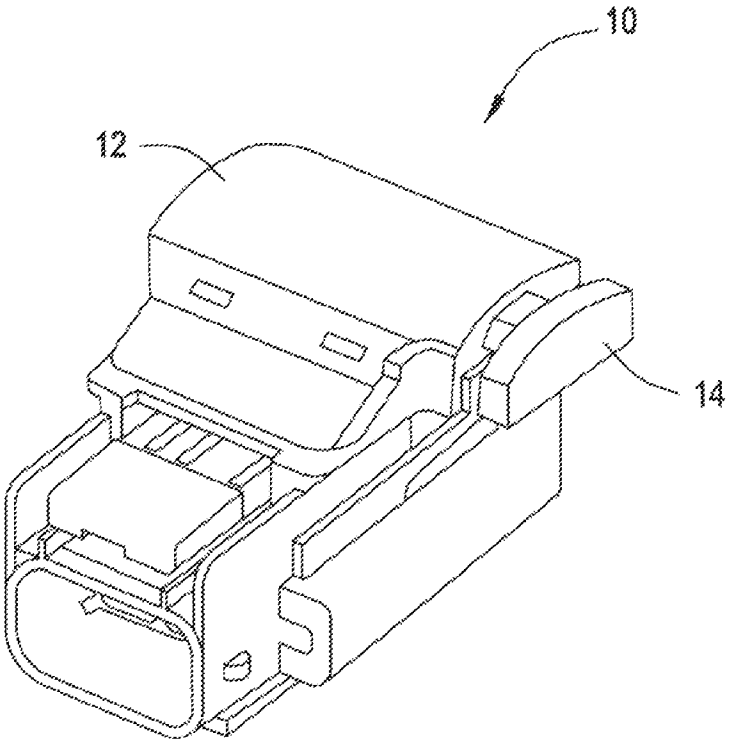

As shown in FIGS. 6 and 7, device 10 is attached to the top of the connector (e.g. Apex 2.8 connector of FIGS. 1-3). To ensure proper seating, protection device 10 audibly locks/snaps into position on the connector with clear visual confirmation. Once in place, on a connector with a CPA in the pre-staged arrangement (e.g. FIG. 2) an opposing connector (connection system) is mated and locked using the connection lock on the female connector. Thereafter, CPA assist 14 is engaged which in turn abuts the CPA and engages into the CPA slot both confirming the connection and locking the connectors together. FIG. 6 shows the female connector with CPA assist 14 of protection device 10 in the pre-staged position and FIG. 7 shows CPA assist 14 in the engaged position.

Applicants note that such an arrangement for device 10 with deflector 12 and CPA assist 14 is constructed to fit onto a connector prior to mating with a second connector and thus is arranged with assist 14 to press the CPA into the CPA slot at a later time after connector mating. However, if desired the present device 10 could be clipped onto a CPA and connector arrangement after mating, but prior to further processing such as painting. In this case the CPA could already be engaged and the CPA assist 14 could be disabled, removed or otherwise not used, as CPA engagement would be completed before device 10/deflector 12 is snapped onto the connectors.

In this arrangement, device 10 not only protects CPA and CPA clot area, but also at least part of the connector lock area as well during any additional manufacturing processes that may occur to the item to which the connector is attached, such as painting, coatings etc. . . . . Application of the protection device 10 with debris deflector 12 and CPA assist 14 ensures the proper function of the CPA as well as leaving the connection serviceable in the future.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

The invention claimed is:

1. A protection device comprising:

a deflector element with a receiving slot on its underside; and a connector position assurance assist coupled to said deflector element, said connector position assurance assist configured to move between a first pre-staged position and a second active position, wherein said protection device is configured to be placed on a connector with said receiving slot configured to be placed over a connector position assurance slot on said connector, and wherein said connector position assurance assist is configured to be moved from said first pre-staged position to said second active position by pressing said connector position assurance assist to engage a connector position assurance positioned within said connector position assurance slot.

2. The protection device as claimed in claim 1, wherein said protection device is constructed from Nylon™.

3. The protection device as claimed in claim 1, wherein said protection device is configured to snap into position on said connector.

* * * * *